United States Patent [19]

Gray, Jr. et al.

[11] Patent Number: 4,595,490

[45] Date of Patent: Jun. 17, 1986

[54] PROCESSING OF HIGH NORMAL PARAFFIN CONCENTRATION NAPHTHA FEEDSTOCKS

[75] Inventors: Robert L. Gray, Jr., Mahopac, N.Y.; Peter L. Oetinger, Louisville, Ky.

[73] Assignee: Union Carbide Corporation, Danbury, Conn.

[21] Appl. No.: 718,368

[22] Filed: Apr. 1, 1985

[51] Int. Cl.[4] ..... C10G 25/03

[52] U.S. Cl. ..... 208/310 R; 208/310 Z; 505/822

[58] Field of Search ..... 208/310 Z, 310 R, DIG. 1; 585/820, 821, 822

[56] References Cited

U.S. PATENT DOCUMENTS

| | | | |
|---|---|---|---|
| 2,912,473 | 11/1959 | Hutchings | 208/310 Z |
| 3,347,783 | 10/1967 | Feldbauer, Jr. | 208/310 Z |
| 3,422,005 | 1/1969 | Avery | 208/310 |
| 3,428,552 | 2/1969 | Turnbull et al. | 208/310 Z |
| 3,451,924 | 6/1969 | Helfferich et al. | 208/310 Z |
| 3,770,621 | 11/1973 | Collins et al. | 208/310 Z |
| 4,176,053 | 11/1979 | Holcombe | 208/310 Z |
| 4,238,321 | 12/1980 | Florack | 208/310 Z |
| 4,350,501 | 9/1982 | Bannon | 585/822 X |
| 4,350,583 | 9/1982 | Fuderer | 208/310 Z |
| 4,354,929 | 10/1982 | Wessels et al. | 208/310 Z |
| 4,358,367 | 11/1982 | Bannon | 208/310 Z |
| 4,359,380 | 11/1982 | Bannon | 208/310 Z |
| 4,498,910 | 2/1985 | Benkmann | 585/821 |

*Primary Examiner*—D. E. Gantz
*Assistant Examiner*—Glenn A. Caldarola
*Attorney, Agent, or Firm*—Alvin H. Fritschler

[57] ABSTRACT

Normal paraffins present in high concentrations in light naphtha streams are separated from non-normal paraffins in a four or more bed adsorption system employing, on a cyclic basis, the processing steps of (1) cocurrent purge/adsorption, (2) cocurrent feed/adsorption, (3) countercurrent purge and (4) countercurrent displacement. A processing sequence is employed wherein the cocurrent purge/adsorption and countercurrent purge steps are carried out on a discontinuous basis, while cocurrent feed/adsorption and countercurrent displacement steps are carried out in overlapping sequence. Control means are provided to assure that the high normal paraffin-containing hydrocarbon feed gas and stripping gas are passed to the appropriate beds for said cocurrent purge/adsorption and countercurrent purge steps on a non-continuous basis, said feed gas being continuously fed to a mix drum for mixture with countercurrent purge effluent before removal for use in said cocurrent purge/adsorption step and in said cocurrent feed/adsorption step of the overall four-step process.

9 Claims, 3 Drawing Figures

TABLE I

TABLE II

PROCESSING OF HIGH NORMAL PARAFFIN CONCENTRATION NAPHTHA FEEDSTOCKS

BACKGROUND OF THE INVENTION

1. Field of the Invention

This invention relates to the separation of normal paraffins from hydrocarbon vapor mixtures thereof with non-normal hydrocarbons. More particularly, it relates to the separation of said normal paraffins present in high concentrations in petroleum naphthas.

2. Description of the Prior Art

The separation of normal paraffins from a hydrocarbon vapor feed stream has been developed in the art, as indicated by the Avery patent, U.S. No. 3,422,005. With respect to gas oil and kerosene feedstocks in particular, the patent discloses the isobaric steps of (1) adsorption, i.e., selective adsorption of normal paraffins; (2) cocurrent purge with n-hexane to sweep out void space vapor containing a high concentration of non-adsorbed components, i.e., non-normal hydrocarbons, from the upper or effluent end of the bed, and (3) countercurrent purge with n-hexane to desorb normal hydrocarbons for discharge from the bottom or feed end of the bed. As will be appreciated by those skilled in the art, various changes or modifications in such processing techniques may be necessary or desirable when other feedstocks are to be treated for such separation of normal paraffins and non-normal paraffins. In the treatment of petroleum naphthas, both light and heavy, a four-step cyclic process variation is commonly employed and includes (1) cocurrent purge/adsorption, i.e., selective adsorption of normal paraffins from the feed gas passed to the bottom or feed end of the bed, with unadsorbed non-normal paraffins displacing residual purge gas remaining from the previous cycle from the top or effluent end of the bed, said step being sometimes referred to herein as the A-1 step; (2) cocurrent feed/adsorption, wherein additional quantities of the feed gas are mixed with the purge effluent from the next succeeding countercurrent purge step and are passed to the bottom of the bed, thereby advancing the adsorption front of adsorbed normal paraffins toward the top of the bed, thus displacing non-normal paraffins from the top of the bed for recovery as a co-product stream, said step being sometimes referred to herein as the A-2 step; (3) countercurrent purge, in which a stripping gas is introduced to the top of the bed and a purge effluent comprising said stripping gas, residual feed components, residual unadsorbed non-normal paraffins, and some desorbed normal paraffins are withdrawn from the bottom of the bed and are recycled for mixture with feed gas and introduction to the bottom of another bed, said countercurrent purge step being sometimes referred to herein as the D-1 step; and (4) countercurrent displacement, in which said stripping gas is introduced to the top of the bed and a normal paraffins-stripping gas product stream is withdrawn from the bottom of the bed, said countercurrent displacement step being sometimes referred to herein as the D-2 step. It will be appreciated that said cyclic process is commonly employed in multi-bed systems, typically containing at least four beds, in which said processing steps are carried out, on a cyclic basis, in each bed in overlapping processing sequence.

In the practice of this four-step process, a slipstream of the hydrocarbon feed gas is used as the feed gas for the A-1 step. The remaining hydrocarbon feed gas is mixed with the D-1 effluent in a mix drum to form A-2 step feed gas. The mix drum facilitates the providing of an even A-2 feed composition during those periods in the cycle in which two beds are simultaneously on the A-2 step. The processing cycle of the prior art, as applied to a five-bed cycle, is illustrated in table I.

It will be seen that the slipstream of the feed gas used for A-1 feed to the system is continuous, with such A-1 feed commencing in bed 2 upon termination of the A-1 step in bed 1, commencing in bed 3 upon termination of said step in bed 2, and the like. Similarly, the D-1 step is carried out in one bed of the system at any given time on a continuous basis. Thus, the termination of the D-1 step in bed 3 is accompanied by the commencing of said step in bed 4, such termination in bed 4 is accompanied by its commencement in bed 5, and the like. It will also be seen that the A-2 and D-2 steps are carried out in such overlapping sequence that, alternately, one bed or two beds simultaneously are on said steps at any point in the overall processing cycle. Flow controllers applied to the A-1 slipstream feed gas and to the D-1 purge gas are thus continuously operating to control the required amount of flow through their associated control valves. No special bypass or controller hook-up is needed to protect said valves from a no-flow condition as part of the processing cycle in said system.

In the carrying out of such petroleum naphthas separation operations, further described in the Holcombe Patent, U.S. No. 4,176,053, it has been found necessary to utilize a five-bed system for the treatment of high normal paraffin concentration feedstocks. Such feedstocks are typically those for which about 80% or more of the total feed gas would be needed as A-1 feed gas in a four-bed system. During the A-1 step, normal paraffins are selectively adsorbed by the bed, with the remaining, unadsorbed non-normals serving to push the stripping gas remaining from the previous D-2 step from the top of the bed. If the normals concentration of the hydrocarbon feedstock is high, a large portion of the total feedstock will be needed to remove the required amount of stripping gas from the bed during said A-1 adsorption step. In a four-bed system, it is possible that, at high normals concentration, essentially all of the feedstock to the system will be needed for the A-1 step, leaving essentially none of the original feedstock available for mixing with the countercurrent purge, i.e., D-1 step, effluent and for use in the A-2 step. By utilizing a five-bed system containing the same total amount of adsorbent material, the A-1 step can be carried out at a lower feed rate, because it is carried out on a continuous basis throughout the cycle. The amount of stripping gas that needs to be removed from the bed during the A-1 step, therefore, is removed over a longer period of time relative to a corresponding four-bed system with a greater proportion of the total cycle time being available for purging.

While the conventional five-bed system serves to overcome the disadvantages encountered in attempting to treat high normal paraffin-containing feedstocks in a corresponding four-bed system, it would nevertheless be desirable to employ four-bed systems in such an application. A significant savings in investment could thus be realized by the use of one less adsorbent bed, with a corresponding reduction in associated manifolding, and a total of six related Remote Operated Valves (ROV's) could be eliminated if a suitable four-bed system could be effectively employed in this application.

It is an object of the invention, therefore, to provide an improved process and system for the separation of normal paraffins from vapor mixtures thereof with non-normal paraffins.

It is another object of the invention to provide an improved process and system for such separation operations suitable for the treatment of high normal paraffin concentration feedstocks.

It is a further object of the invention to provide a four-bed process and system for separation of normal paraffins contained at high concentrations in vapor phase mixtures thereof with non-normal paraffins.

With these and other objects in mind, the invention is hereinafter further described in detail, the novel features thereof being particularly pointed out in the appended claims.

SUMMARY OF THE INVENTION

The objects of the invention are accomplished by the use of a processing cycle variation wherein the adsorption, i.e., A-1, and the countercurrent purge, i.e., D-1, steps are carried out on a discontinuous basis in a four-bed cycle and system in which the A-2 and D-2 steps are carried out in an overlapping sequence such that, alternately, one and two beds are on each of said processing steps at given times throughout the cyclic operation. Control features are incorporated in the system to accommodate the time intervals in which no A-1 or D-1 feed streams are being passed to a bed in the system. Contrary to conventional four or five-bed operations, all of the hydrocarbon feed gas is passed to a mix drum for mixture therein with D-1 effluent gas, with A-1 feed gas being removed therefrom and passed to the adsorber that is on an A-1 step at any particular time in the overall cycle.

DETAILED DESCRIPTION OF THE INVENTION

Figure 1:
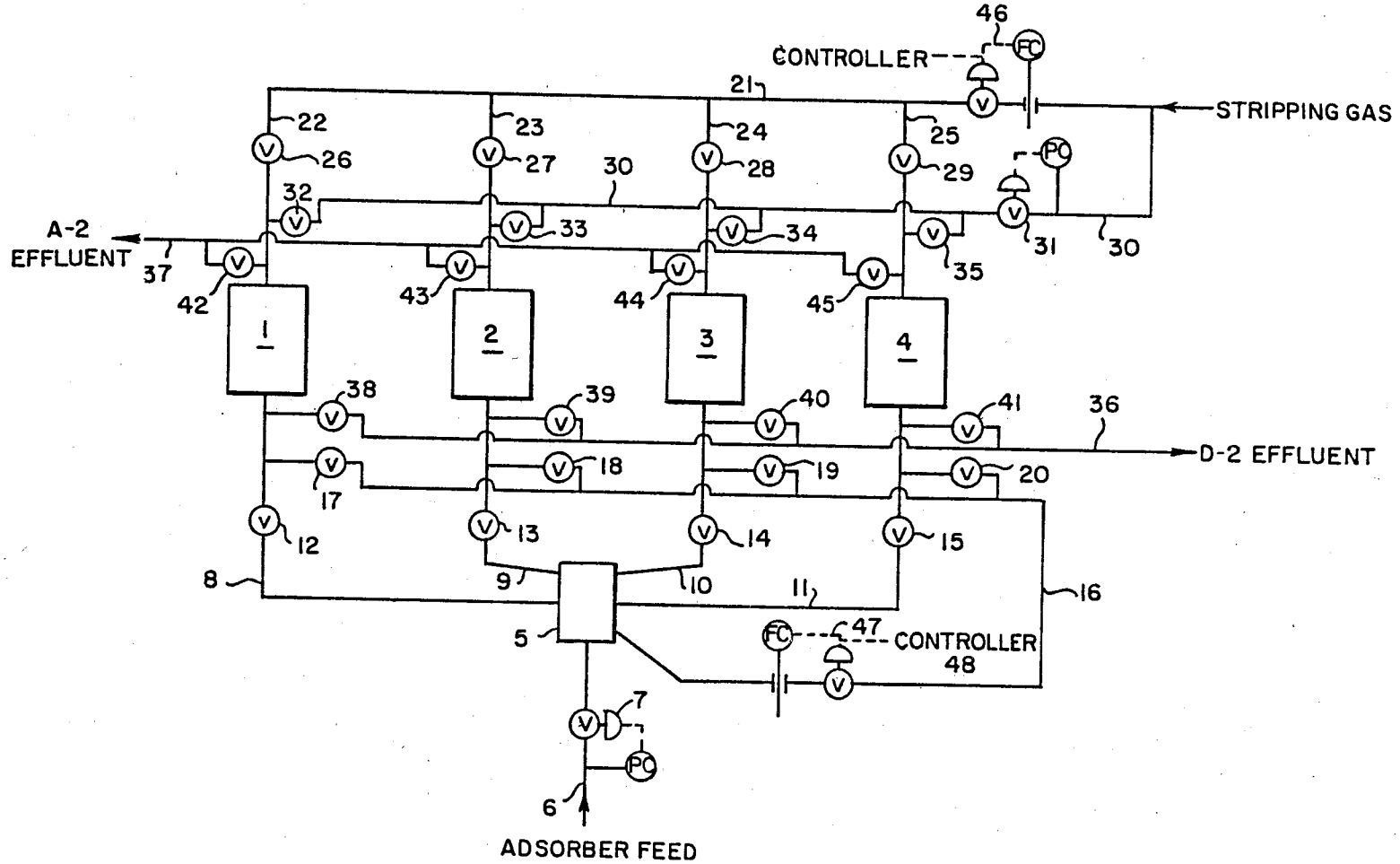
FIG. 1 illustrates a schematic flowsheet for a four-bed embodiment of the invention.
Figure 2:
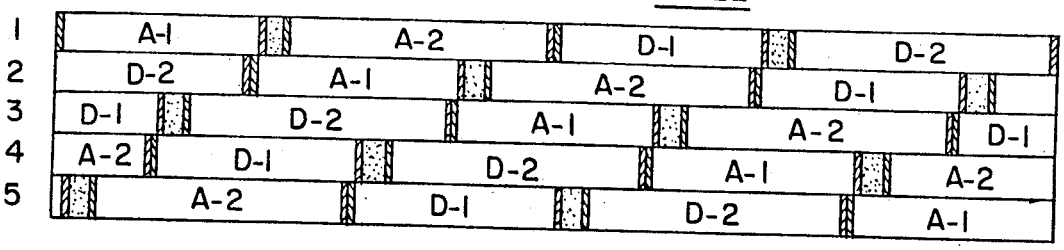
FIG. 2 depicts Table I which is a representation of a prior art of cycling scheme as previously described.
Figure 3:
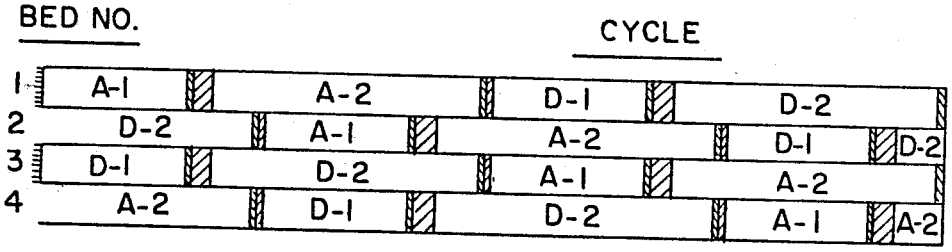
FIG. 3 illustrates Table II which is a representation of the cycling scheme for the present invention.

The invention enables four-bed adsorption systems to be advantageously employed for normal paraffin, non-normal paraffin separations in the processing of high normal paraffin hydrocarbon feedstocks for which five-bed systems would heretofore have been required. Thus, operations in which the conventional four-bed process and system referred to above would require the utilization of 80% or more of the total feed stream in the A-1 step, leading the art to employ five-bed systems in such cases, can be carried out effectively in four-bed systems operated in accordance with the invention.

The invention will be understood to involve the cyclic operation of the four conventional processing steps referred to above, i.e. the A-1, A-2, D-1 and D-2 steps, carried out in accordance with the four-bed embodiment illustrated in Table II.

In Table II, the A-1, A-2, D-1 and D-2 steps are as described above with respect to conventional processing. As in the conventional 5-bed cycle of Table I, the cycle illustrated in Table II provides for an overlap of the A-2 and of the D-2 steps in the course of the cyclic operation of the process. At certain periods of time in the overall cycle, it will be seen that the A-2 step and the D-2 step are carried out in one bed only, while at other intervals of time, two of the four beds in the system are on such steps. Thus, upon commencement of the A-2 step in bed 1, it will be seen that bed 4 is completing its A-2 step. Upon such completion of the A-2 step in bed 4, an interval of time exists in which bed 1 alone is on the A-2 step. When the A-2 step nears its completion in bed 1, the A-2 step is commencing in bed 2, with an overlap occurring until the completion of the A-2 step in said bed 1. Similarly, the commencement of the D-2 step in bed 1 overlaps the completion of said D-2 step in bed 4, after which bed 1 alone is on the D-2 step for an interval of time. The completion of the D-2 step on bed 1 then overlaps the commencement of said step in bed 2, with bed 2 alone being on the D-2 step for an interval of time upon completion of the D-2 step in said bed 1. Such overlap of two beds on the A-2 and D-2 steps serves to smooth out concentration/flow fluctuations inherent in the operation of the process.

To provide for such desirable overlap during four-bed operation, the practice of the invention provides for a period of time during which no bed is on either the A-1 step or the D-1 step. This period of time, which is typically about 35% of the overall cycle time, is in contrast to the prior art cycle of Table I, wherein at any given time in the cycle, one bed is on the A-1 step and another bed is on the D-1 step. It will be seen in Table II that the time period of discontinuity is the same for the A-1 and the D-1 steps, with the periods in which said A-1 and D-1 steps are carried out coinciding, and the periods of discontinuity likewise coinciding. Thus, the A-1 step in bed 1 is carried out for the same period of time as the D-1 step in bed 3. After the same period of discontinuity in which no bed is on either the A-1 or the D-1 steps, because of the above-indicated overlap in which two beds are on the A-2 step and two beds are on the D-2 step, the commencement of the A-1 step in bed 2 coincides with the commencement of the D-1 step in bed 4. As a result, valve sequence control means are provided in the practice of the invention to provide "on", or flow control, and "off", or flow freeze, regulation of the flow control valves controlling the passage of feed gas for the carrying out of the initial adsorption A-1 step and the countercurrent purge D-1 step. It will be appreciated that no such valve sequence control need be employed in the practice of the conventional process illustrated in Table I above since the A-1 and the D-1 steps are carried out on a continuous basis in the processing cycle of such conventional operations.

As noted above, conventional practice provides for a slipstream of the hydrocarbon vapor feed stream to be used as the A-1 step feed gas. The remaining feed gas then mixes with the D-1 step effluent in a mix drum to form the A-2 step feed gas. Such an approach is not feasible in the practice of the novel cycle of the invention illustrated in Table II, because little or no feed would be available to mix with the D-1 effluent due to the amount that would be required for the A-1 step. In the practice of the invention, therefore, all of the hydrocarbon vapor feed stream passes to the mix drum for mixture therein with the D-1 effluent. The A-1 feed is then removed from the mix drum and controlled for flow to the appropriate adsorbent bed on the A-1 step at a particular interval in the overall cycle. The remaining feed stream not so removed from the mix drum as part of the A-1 feed, together with the D-1 effluent with which it is mixed, is passed to the particular bed or beds on the A-2 step at particular intervals in the overall cycle.

Referring to FIG. I, the four-bed system illustrated therein contains four beds, namely beds 1, 2, 3, and 4 operated in accordance with the four step, cyclic process referred to in Table II above in overlapping sequence. All of the feed gas to the system passes to mix drum 5 through inlet line 6 having process control valve 7 positioned therein. The total feed gas mixes with the D-1 effluent in said mix drum 5, said D-1 effluent being passed to said mix drum 5 from beds 1, 2, 3 and 4, in turn, through lines 8, 9, 10 and 11, respectively, each of which contains a conventional Remoted Operated Valve, i.e., ROV 12, 13, 14 and 15, respectively.

The A-1 feed is removed from mix drum 5 through line 16 and passes, in appropriate processing sequence to beds 1, 2, 3 or 4 through ROV 17, 18, 19 or 20. The D-1 feed, i.e., countercurrent purge stripping gas, enters the system through line 21 and passes to beds 1, 2, 3 or 4 in appropriate sequence through lines 22, 23, 24, or 25, respectively, each of which lines contains a Remoted Operated Valve, i.e., ROV 26, 27, 28 or 29, respectively.

The D-2 feed, i.e., countercurrent displacement stripping gas, enters the system through line 30, containing process control valve 31, and passes to said beds 1, 2, 3 or 4 through ROV 32, 33, 34 or 35, and through said lines 22, 23, 24 or 25, respectively. Line 30 is also used in reverse, it should be noted, for the A-1 effluent. Thus, said A-1 effluent leaves bed 1, for example, through line 22, and passes through ROV 32 and said line 30 for discharge from the system. In turn, A-1 effluent likewise leaves beds 2, 3 and 4 through lines 23, 24 and 25, and ROV 33, 34, and 35, respectively, for passage to said line 30 and discharge from the system.

As will be seen from FIG. 1 lines 8, 9, 10 and 11, used to pass D-1 effluent to mix drum 5, can also be used to pass A-2 feed from said mix drum to beds 1, 2, 3 and 4, respectively. The remaining streams, i.e., D-2 effluent and A-2 effluent, are conveniently removed from the system through discharge lines 36 and 37, respectively. The normal paraffin-stripping gas product stream, i.e., D-1 effluent, is passed from beds 1, 2, 3 and 4 into said line 36 through ROV 38, 39, 40 and 41, respectively. Similarly, the non-normal paraffin co-product stream, i.e. A-2 effluent, is passed from beds 1, 2, 3, and 4 into said line 37 through ROV 42, 43, 44 and 45, respectively.

It will be seen that each bed of the system has a total of six Remote Operated Valves associated therewith. In the conventional 5-bed equivalent to the 4-bed embodiment of the invention, a total of six ROV's is similarly associated with each adsorbent bed. This is the basis for the observation above that a total of six ROV's could be eliminated, together with an adsorbent bed and associated manifolding, by the desired development of a 4-bed system to replace the conventional 5-bed system of the prior art.

As is discussed above and shown by Table II, the processing cycle of the invention provides for a significant period of time during which none of the four beds in the system is on the A-1 step. During this same period of time, none of the beds is on the D-1 step. By contrast, the conventional 5-bed system is such that one of the beds is on the A-1 step at any given time in the processing cycle and another bed is in the D-1 step at any given time. No special by-pass or controller arrangement is needed, therefore, in the conventional approach to protect the flow controller valves in the A-1 and D-1 feed lines from a no-flow condition. By contrast, it will be appreciated that provisions must be made to either by-pass the A-1 and D-1 feeds, or to "freeze" the flow valves, i.e., flow control valve 46 in D-1 feed line 21 and flow control valve 47 in A-1 feed line 16. In the absence of some such control feature, when each particular A-1 and D-1 feed step ends, and no bed is on an A-1 or D-1 step, the flow controllers will sense no flow and will open wide in an effort to permit flow to occur. When the A-1 step is then commenced in a bed following the desired period of discontinuity, a large surge of feed gas may pass to the beds before the flow controller can control it, thereby possibly causing pressure bumps in the system and undesired molecular sieve movement.

In the practice of the invention, this problem is overcome by connecting the two flow controllers for the A-1 and D-1 step feed streams, i.e., flow controllers 47 and 46, respectively, to the conventional Valve Sequencing Controller (VSC), not shown in detail but referred to generally by the numeral 48, with such flow controllers thus being controlled thereby between "on", i.e., flow control, and "off", i.e., freeze, positions according to the time in an overall processing cycle and whether said A-1 and D-1 steps are to be carried out, or are discontinued, at the point in the processing cycle. By thus connecting the A-1 and D-1 flow controllers to the VSC 48 of the system and utilizing a valve actuating signal that permits the valve to freeze in position when indicated by the VSC, the A-1 and D-1 flow controllers can hold in that position when so indicated by the VSC as being appropriate at particular stages of the processing cycle. At the end of the A-1 and D-1 steps, therefore, the VSC will send a signal that cuts off the flow controller signal, thus freezing the valves at their last control position. When the A-2 and D-2 step overlaps referred to above are complete and the A-1 and D-1 steps begin again, the VSC will send a signal to reconnect the flow controller signal with the flow control valve, thus permitting control of the flow rates once again.

In an illustrative example, a typical light straight run naphtha feedstock comprising $C_5$–160° F. material containing 40–50% normal paraffins, 7–10% naphthenes, 2% benzene and less than 1% $C_7$'s, is passed to a four-bed system essentially as shown in the drawing for processing in accordance with the invention at about 600°–650° F. and 250 psia. By the connection of flow controllers 46 and 47 to Valve Sequencing Controller 48, said flow controllers are held in a freeze position at the end of the D-1 and A-1 feed steps in particular beds. This freeze position is maintained until the end of the period of discontinuity with respect to said steps, whereupon said D-1 and A-1 steps are commenced in the next beds of the system in accordance with the processing sequence as shown in Table II. Using the process of the invention, the feedstock can be readily processed for separation of normal paraffins and non-normal hydrocarbons, using hydrogen as the stripping gas, in the indicated four-bed system. By contrast, the prior art processing sequence of Table I requires that a fifth adsorbent bed, with associated valves, piping and controls, be utilized since the high normal paraffin concentration of the feedstock is such that more than 80% of the total feed would be required for A-1 feed purposes.

Those skilled in the art will appreciate that various changes and modifications can be made in the details of the process and apparatus as described and illustrated herein without departing from the scope of the invention as set forth in the appended claims. While the invention has been described with reference to the desired use of four adsorbent beds rather than the five beds of conventional practice, it will be appreciated that the invention should not be construed as being limited to four bed systems. Thus, the invention can be practiced also in five or more bed systems, including such systems in which the various processing steps are carried out in parallel in more than one bed, or series of beds, at any given time. In addition, the feedstock that can be treated in accordance with the invention shall be understood to constitute any commercially available petroleum naphtha or similar feedstock containing a high concentration of normal paraffins such that, as indicated above, about 80% or more of the total feed gas would be required for the A-1 feed gas in the desired system used in accordance with the prior art processing sequence. In such circumstances, an inadequate amount of the original feedstock would generally be available for mixing with the D-1 effluent for use in the A-2 step.

Feedstocks containing about 40% or more normal paraffins in a mixture of said normal paraffins and non-normal paraffins are advantageously separated in accordance with the present invention rather than by the prior art approach referred to above. Those skilled in the art will appreciate that other feedstocks may also be treated in accordance with the invention. For example, petroleum naphthas having lower normal paraffin concentrations of about 35% or more may also be treated in accordance with the invention, and the application of the invention to such feedstocks may also enable equipment and processing simplifications to be realized vis-a-vis the practice of the conventional prior art approach as described above. In general, the invention is particularly useful in the treatment of $C_4$ to about $C_{10}$ material, such as light straight run naphtha comprising $C_4$ up to about $C_7$ or 200° F. boiling point, material, and heavy straight run naphtha comprising $C_6$–$C_{10}$, or about 200°–400° F. boiling point material. In addition to the typical feedstock referred to above, another common feedstock, sometimes referred to as light natural gasoline, comprises $C_5$–170° F. material containing 35–45% normal paraffins, 7–10% naphthenes, 1% benzene and less than 1% $C_7$'s.

The adsorbent employed in the practice of the invention can be any suitable commercially available material capable of facilitating the desired selective adsorption of normal paraffins as a more readily adsorbable component of the feed gas mixture, with non-normal paraffins constituting a less readily adsorbable component thereof. Crystalline zeolitic molecular sieves are particularly useful for this application. Such materials can be any of the naturally occurring or synthetically produced three-dimensional crystalline zeolitic aluminosilicates from which the water of hydration can be removed without collapse of the crystal lattice and which will selectively, on the basis of molecular size, adsorb normal paraffins from the mixture thereof with branched chain and/or cyclic paraffins which comprises the feed stream. Since normal paraffins have a minimum cross-sectional diameter of about 5 Angstroms, molecular sieves having pore diameters of about 5 Angstroms are preferred for the practice of the present invention. Especially suitable are the cation forms of zeolite A which have pore diameters of about 5 Angstroms. Zeolite A is well known in the art as a synthesized zeolite having a very large adsorption capacity and, depending on the cation species present, exhibits apparent pore diameters ranging from about 3 to about 5 Angstroms. As prepared in the sodium cation form, zeolite A has pore diameters of about 4 Angstroms. When 25 percent, preferably at least 40 percent, of the sodium cations are exchanged by calcium and/or magnesium cations, the effective pore diameter increases to about 5 Angstroms. Zeolite A as used herein in the specification and claims is intended to denote the zeolite described and defined in U.S. Pat. No. 2,882,243. Other zeolitic molecular sieves which, in appropriate cation forms, have pore diameters of about 5 Angstroms and which, although having less adsorption capacity than zeolite A, are suitably employed include zeolite T, U.S. Pat. No. 2,950,952 and the minerals chabazite and erionite.

The stripping gas used in the practice of the invention is preferably hydrogen, but may be any permanent non-sorbable gas, or mixture of gases, having molecular dimensions sufficiently small to enter the intracrystalline cavities of the molecular sieve, or like cavities of other adsorbent materials, but that are not themselves strongly enough adsorbed to displace the normal hydrocarbons adsorbed thereon to any significant degree. Nitrogen, helium, and methane are among the other gases that may be considered for use in the practice of the invention, with various others also being known but commonly lacking commercial availability at reasonable cost.

It will be appreciated that the process of the invention is generally carried out under essentially isobaric and isothermal conditions. Thus, the operating pressure range employed is typically from about 50 psia to about 400 psia although pressures outside this range may be applicable in particular circumstances. In general, the pressure employed in any given application is dependent on the particular feedstock being treated, with higher pressures being used for more volatile feedstocks to enhance the separation obtained and to facilitate the condensation of product effluents. It should be noted that it is desirable that none of the feedstock components condense in the void space of the adsorbent beds since such liquid phase material cannot be removed by the quantity of non-sorbable purge gas generally employed for purposes of the invention.

The process is operated at a substantially uniform temperature generally within the range of from about 350° F. to about 750° F. At temperatures below about 350° F., the efficiency of the non-sorbable stripping gas is decreased to the point that undesirably large quantities are required to adequately remove the normal paraffins from the bed. Above about 750° F., on the other hand, the rate of coke deposition increases rapidly, and the need for more frequent oxidative regenerations of the adsorbent material is found to exist. Those skilled in the art will appreciate that the isothermal nature of the process denotes that the temperature of the feed gas and of the stripping gas are essentially the same, i.e. typically within about 30° F., at the point of entry into an adsorbent bed, It will be understood that, as in any adsorption-desorption cycle, it may be possible for thermal gradients to develop in the bed due to the heats of adsorption and desorption pertaining to the operation of the process.

It will be seen that the invention provides a very useful improvement in the art of separating normal paraffins, present in high concentration, from non-normal paraffins, as in light petroleum naphthas. By enabling such separations to be carried out in four-bed systems, as compared to the necessary use of five beds in the prior art approach, the overall technical-economic feasibility of carrying out such separations is enhanced, and the hydrocarbon separation art is significantly advanced.

We claim:

1. In an isobaric process for separating normal paraffins from non-normal hydrocarbons in a vapor feed stream by (1 ) cocurrent purge/adsorption with the selective adsorption of normal paraffins by passage of said feed gas stream to the feed end of an adsorbent bed in a system having four or more beds, with unadsorbed non-normal hydrocarbons displacing residual purge gas from the effluent end of the bed, (2) cocurrent feed/adsorption with additional quantities of said feed gas mixed with purge effluent from the next succeeding countercurrent purge step (3) being passed to the feed end of the bed, thereby advancing an adsorption front of adsorbed normal paraffins toward the effluent end of the bed, thus displacing non-normal hydrocarbons from the effluent end of the bed for recovery as a co-product stream, (3) countercurrent purge with a stripping gas being introduced to the effluent end of the bed and a purge effluent comprising stripping gas, residual unadsorbed non-paraffins and some desorbed normal paraffins being withdrawn from the feed end of the bed and recycled for mixture with feed gas to the bottom of a bed in said system, and (4) countercurrent displacement with the introduction of stripping gas to the top of the bed and the withdrawal of normal paraffins, together with stripping gas, as a product stream from the bottom of the bed, the improvement comprising carrying out said processing sequence so that, at the end of the cocurrent purge/adsorption and the countercurrent purge steps in one bed, the passage of said feed gas for said cocurrent purge/adsorption step and said stripping gas for said countercurrent purge step are discontinued for an interval of time during which said cocurrent feed/adsorption and countercurrent displacement steps are carried out in an overlapping manner such that at least two beds are on each of said steps during said interval, said feed gas entering the system by initial passage to a mix drum from which said feed gas for the cocurrent purge/adsorption step and said cocurrent feed/adsorption step are passed, said countercurrent purge effluent from step (3) being passed to said mix drum for mixture with said feed gas therein and passage to an adsorbent bed as part of the feed gas for said cocurrent purge/adsorption step and said cocurrent feed step, whereby the overlap of steps enables concentration and/or flow fluctuations inherent in the process to be obviated, and the process can advantageously be carried out with a desirable reduction in the size of the adsorption system and associated equipment.

2. The process of claim 1 in which said adsorption system comprises four adsorbent beds.

3. The process of claim 2 in which said feed gas stream contains at least about 35% normal paraffins.

4. The process of claim 3 in which said feed gas stream comprises a petroleum naphtha feedstock at least about 80% of which would be required for the selective adsorption step in the absence of said discontinuity of said selective adsorption and said countercurrent purge steps in a four bed system in which the feed for the selective adsorption step is withdrawn from the feed gas stream before said feed gas stream is passed to the mix drum.

5. The process of claim 4 in which said stripping gas comprises hydrogen.

6. The process of claim 1 and including controlling the flow of feed gas for the cocurrent purge/adsorption step and the flow of stripping gas for said countercurrent purge step such as to freeze said controls in the position reached at the end of said cocurrent purge/adsorption and countercurrent purge steps for the duration of said interval of time in which no flow of feed gas and of stripping gas for said steps is in effect, whereby undesired pressure bumps and adsorbent movement within the adsorbent beds due to surges in gas upon resumption of the passage of feed gas and stripping gas for said steps are effectively avoided.

7. The process of claim 6 in which said adsorption system comprises four beds.

8. The process of claim 7 in which said feed gas stream contains at least about 35% normal paraffins.

9. The process of claim 8 in which said feed gas stream contains at least about 40% normal paraffins.

* * * * *